US011095029B2

(12) United States Patent
Hsieh et al.

(10) Patent No.: US 11,095,029 B2
(45) Date of Patent: Aug. 17, 2021

(54) ANTENNA DEVICE

(71) Applicant: PEGATRON CORPORATION, Taipei (TW)

(72) Inventors: Chia-Hsing Hsieh, Taipei (TW); An-Shyi Liu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 22 days.

(21) Appl. No.: 16/581,624

(22) Filed: Sep. 24, 2019

(65) Prior Publication Data

US 2020/0112092 A1 Apr. 9, 2020

(30) Foreign Application Priority Data

Oct. 4, 2018 (TW) ..... 107135126

(51) Int. Cl.
*H01Q 3/24* (2006.01)
*H01Q 5/30* (2015.01)
(Continued)

(52) U.S. Cl.
CPC ..... *H01Q 3/247* (2013.01); *H01Q 1/50* (2013.01); *H01Q 3/24* (2013.01); *H01Q 5/30* (2015.01); *H01Q 9/16* (2013.01); *H01Q 19/18* (2013.01)

(58) Field of Classification Search
CPC ..... H01Q 3/247; H01Q 1/50; H01Q 5/30; H01Q 19/18; H01Q 9/16; H01Q 3/24
(Continued)

(56) References Cited

U.S. PATENT DOCUMENTS 5,625,894 A * 4/1997 Jou ..... H04B 1/52 333/103
5,966,102 A * 10/1999 Runyon ..... H01Q 1/246 343/797
(Continued)

FOREIGN PATENT DOCUMENTS

CN 106450797 2/2017
JP 2004173062 6/2004
(Continued)

OTHER PUBLICATIONS

"Search Report of Europe Counterpart Application", dated Feb. 10, 2020, p. 1-p. 11.
(Continued)

*Primary Examiner* — Hai V Tran
(74) *Attorney, Agent, or Firm* — J.C. Patents

(57) ABSTRACT

An antenna device includes first antenna units, second antenna units, first switching circuits and second switching circuits. The first antenna units generate radio frequency (RF) signals operating at a first frequency. The second antenna units generate RF signals operating at a second frequency. The first frequency is larger than the second frequency. The first switching circuits selectively enable at least one of the first antenna units. Each of the first switching circuits includes a first switch element and a second switch element. The first switch element is connected in parallel with an inductor. The second switch element is connected in parallel with another inductor. The second switching circuits selectively enable at least one of the second antenna units.

9 Claims, 8 Drawing Sheets

(51) Int. Cl.
*H01Q 1/50* (2006.01)
*H01Q 19/18* (2006.01)
*H01Q 9/16* (2006.01)

(58) Field of Classification Search
USPC ..... 343/876
See application file for complete search history.

(56) References Cited

U.S. PATENT DOCUMENTS

| | | | | |
|---|---|---|---|---|
| 7,023,909 | B1 | 4/2006 | Adams et al. | |
| 7,696,946 | B2 * | 4/2010 | Shtrom | H03H 7/383 343/853 |
| 9,570,799 | B2 * | 2/2017 | Shtrom | H01Q 9/32 |
| 9,774,081 | B2 * | 9/2017 | Su | H01Q 19/17 |
| 2005/0062667 | A1 * | 3/2005 | Shirosaka | H01Q 3/2605 343/794 |
| 2006/0192720 | A1 | 8/2006 | Shtrom | |
| 2015/0349418 | A1 * | 12/2015 | Patron | H01Q 9/44 343/836 |
| 2016/0301136 | A1 * | 10/2016 | Jan | H01Q 9/0414 |
| 2018/0269936 | A1 * | 9/2018 | Chen | H04B 7/0447 |
| 2019/0245278 | A1 * | 8/2019 | Hsieh | H01Q 3/247 |

FOREIGN PATENT DOCUMENTS

| | | |
|---|---|---|
| JP | 2005176120 | 6/2005 |
| KR | 20040092382 | 11/2004 |
| KR | 20090026332 | 3/2009 |
| KR | 20140114691 | 9/2014 |
| TW | 201637286 | 10/2016 |

OTHER PUBLICATIONS

"Office Action of India Counterpart Application", dated Jan. 19, 2021, p. 1-p. 7.

* cited by examiner

ANTENNA DEVICE

CROSS-REFERENCE TO RELATED APPLICATION

This application claims the priority benefit of Taiwan application serial no. 107135126, filed on Oct. 4, 2018. The entirety of the above-mentioned patent application is hereby incorporated by reference herein and made a part of this specification.

BACKGROUND

Technology Field

The present disclosure relates to an antenna device, and more particularly to a dual-frequency antenna device capable of switching beamformings.

Description of Related Art

With the rapid development of wireless communication technology, it is gradually becoming important to effectively use frequency bands and increase the stability of wireless communication transmission as well as communication quality. Nowadays, the most common way to solve the lack of frequency bands is to use a communication device with a dual-frequency antenna.

However, conventional dual-band antennas are not only bulky, but there is interference between high and low frequencies, not to mention, poor directivity and front-to-back ratio.

Therefore, it is currently an important goal to design an antenna device that has better directivity and front-to-back ratio, and further does not cause interferences between low-frequency signals and high-frequency signals.

SUMMARY

In order to solve the above problem, an antenna device provided by the present disclosure includes a plurality of first antenna units, a plurality of second antenna units, a plurality of first switching circuits, and a plurality of second switching circuits. The plurality of first antenna units generate radio frequency (RF) signals operating at the first frequency. Each of the plurality of second antenna units is coupled to the corresponding first antenna unit of the plurality of first antenna units, and generate RF signals operating at the second frequency, wherein the first frequency is greater than the second frequency. The plurality of first switching circuits are respectively coupled to the plurality of first antenna units, and configured to selectively enable at least one of the first antenna units according to a plurality of control signals from a control circuit, each of the plurality of first switching circuits includes a first switching element and a second switching element, the first switching element is connected in parallel with an inductor, and the second switching element is connected in parallel with another inductor. The plurality of second switching circuits are respectively coupled to the plurality of second antenna units, and configured to selectively enable at least one of the plurality of second antenna units according to the plurality of control signals.

In summary, the present disclosure provides a plurality of switching elements on the antenna unit in the antenna device to achieve a radiation pattern in which the high and low frequencies can be switched through the plurality of switching elements, and a better front-to-back ratio can be attained.

BRIEF DESCRIPTION OF THE DRAWINGS

In order to make the aforementioned features and advantages of the disclosure more comprehensible, embodiments accompanying figures are described in detail below.

DETAILED DESCRIPTION

In order to make the description of the present disclosure more detailed and complete, reference is made to the accompanying drawings and the various embodiments described below. On the other hand, commonly known elements and steps are not described in the embodiments to avoid unnecessarily limitation to the disclosure.

The terms "coupled" or "connected" as used in the various embodiments below may mean that two or more elements are "directly" in physical or electrical contact, or are "indirectly" in physical or electrical contact, and may also mean that two or more elements interact with each other.

In some embodiments, an antenna device 100 disclosed in the present disclosure is an antenna device 100 with adjustable radiation pattern, which can adjust the radiation patterns at high and low-frequencies generated by the antenna device 100 according to the user's location, thereby achieving greater transmitting efficiency.

Figure 1:
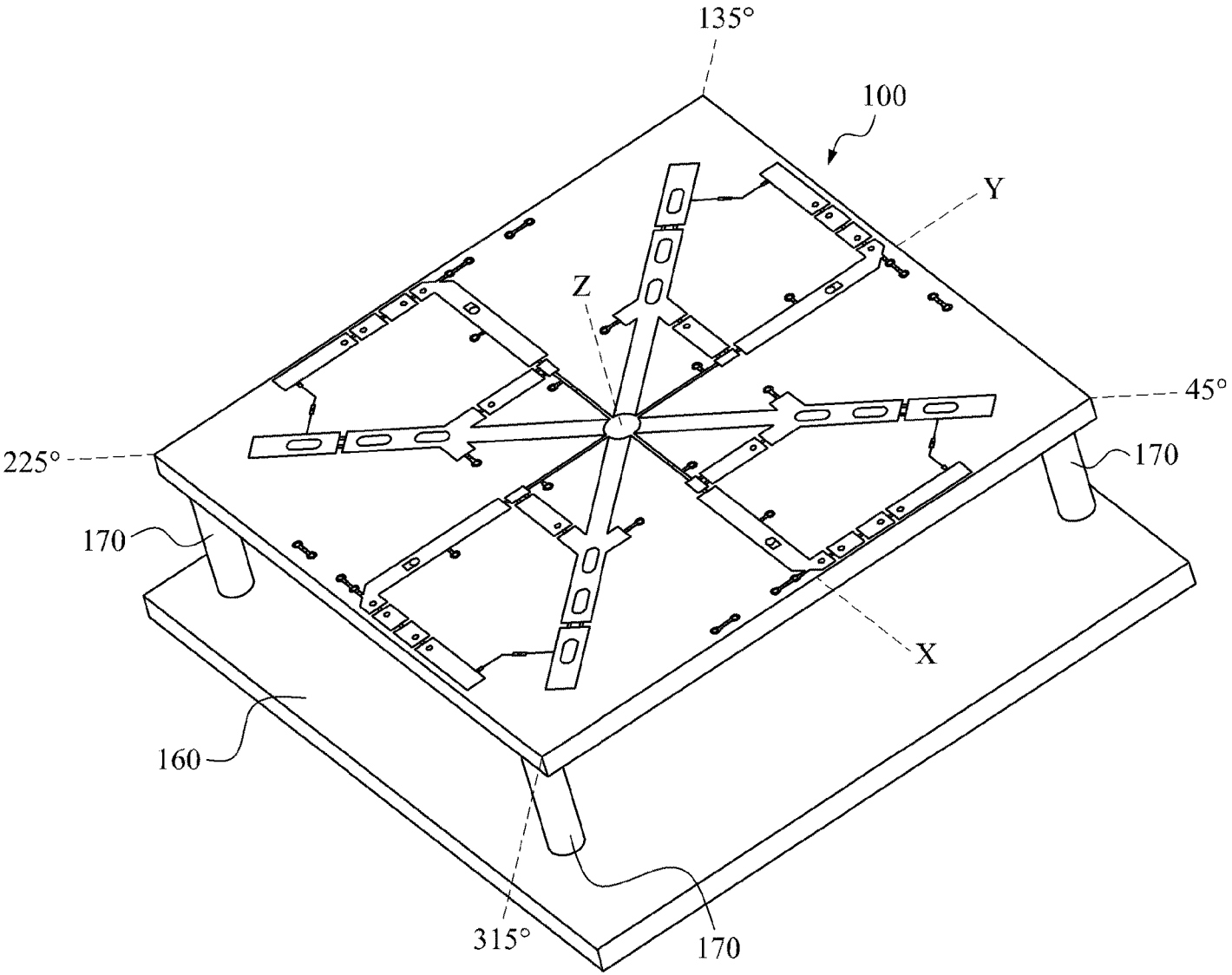
FIG. 1 is a perspective view of an antenna device according to some embodiments of the present disclosure.

FIG. 1 is a perspective view of an antenna device 100 according to some embodiments of the present disclosure. As shown in FIG. 1, in some embodiments, the antenna device 100 is disposed on a ground plane 160 and connected to the ground plane 160 through four pillars 170 connected with each other. In some embodiments, the antenna device 100 is a horizontally polarized antenna device for generating horizontal radiation.

In some embodiments, the antenna device 100 may be integrated in an electronic device having wireless communication functions, such as an access point (AP), a personal computer (PC), or a laptop. However, the present disclosure is not limited thereto, and any electronic device capable of supporting multi-input multi-output (MIMO) communication technology and having communication functions falls within the scope of the disclosure. In practical applications, the antenna device 100 adjusts its radiation pattern according to the control signals to realize an omnidirectional radiation pattern or a directional radiation pattern.

Figure 2A:
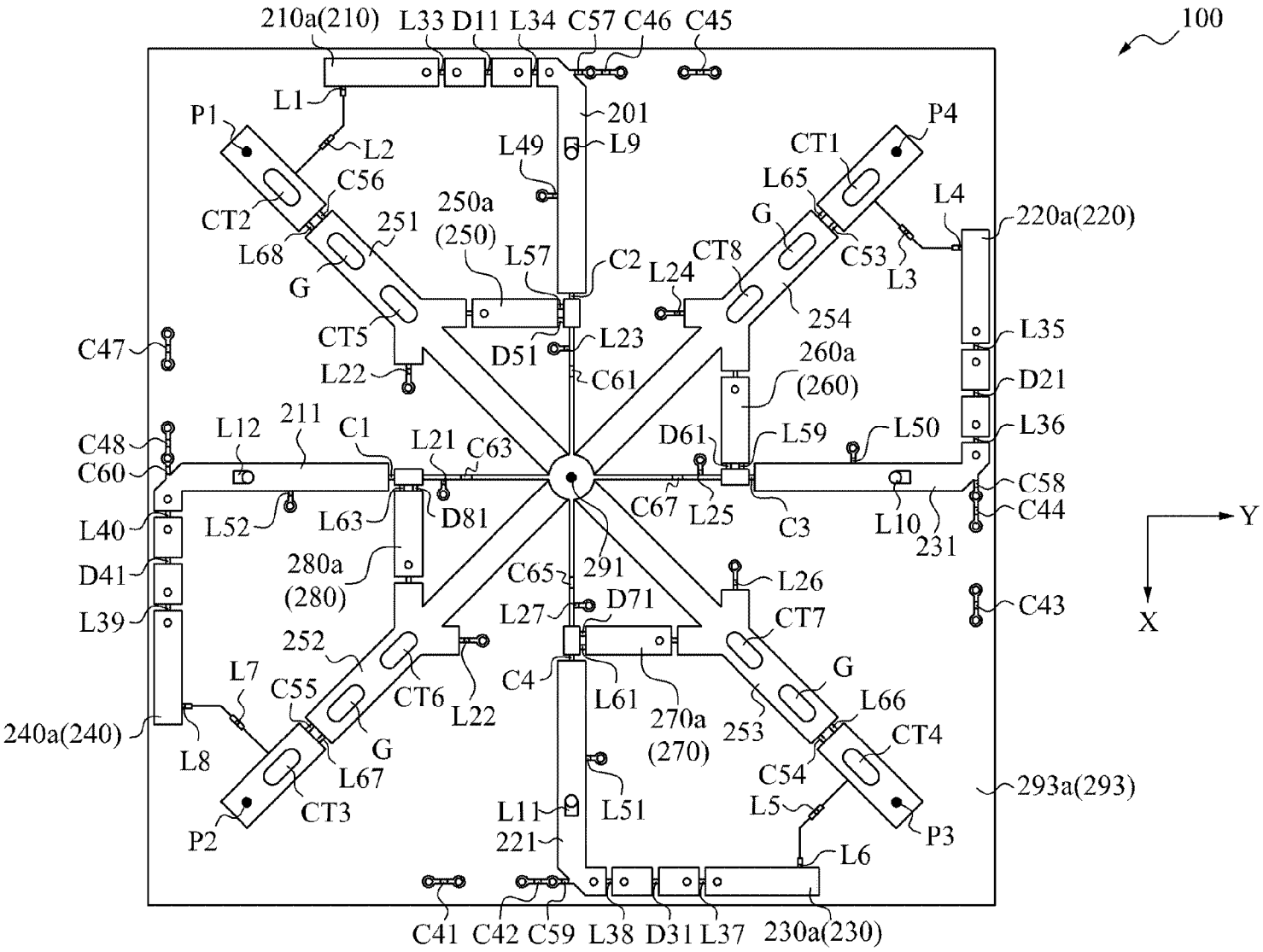
FIG. 2A is a top view of an antenna device according to some embodiments of the present disclosure.
Figure 2B:
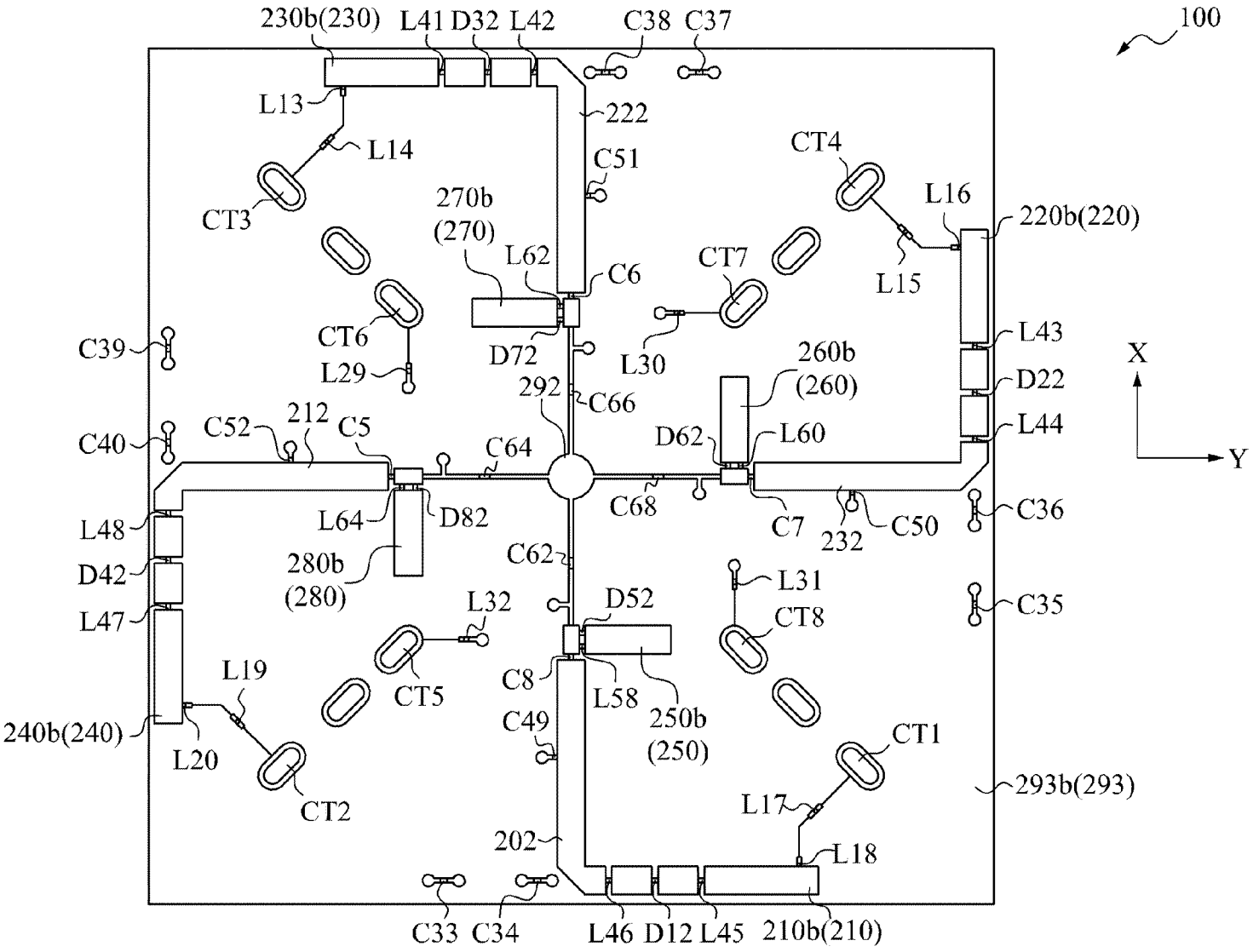
FIG. 2B is a bottom view of an antenna device according to some embodiments of the present disclosure.

In some embodiments, reference is made to FIG. 2A and FIG. 2B together. FIG. 2A is a top view of an antenna device 100 according to some embodiments of the present disclosure, and FIG. 2B is a bottom view of an antenna device 100 according to some embodiments of the present disclosure. In some embodiment, the antenna device 100 is suitable for operating at high frequency and low frequency simultaneously. For example, the high frequency includes 5.5 GHz and the low frequency includes 2.45 GHz, but is not limited thereto, and any frequency suitable at which the antenna device 100 operates falls within the scope to be protected by the present disclosure.

In some embodiments, as shown in FIG. 2A and FIG. 2B, the antenna device 100 includes antenna units 210, 220, 230, and 240, reflecting units 251, 252, 253, and 254, transmitting lines 201, 202, 211, 212, 221, 222, 231, and 232, a signal feeding point 291, an antenna ground terminal 292 and a substrate 293, wherein the transmitting line 201 is connected to the signal feeding point 291, the antenna unit 210 and the antenna unit 250, and the transmitting line 211 is connected to the signal feeding point 291, the antenna unit 240 and the antenna unit 280, and the transmitting line 221 is connected to the signal feeding point 291, the antenna unit 230 and the antenna unit 270, and the transmitting line 231 is connected to the signal feeding point 291, the antenna unit 220 and the antenna unit 260.

In the embodiment, the antenna device 100 has eight antenna units 210, 220, 230, 240, 250, 260, 270, and 280, which are classified into four low-frequency antenna units 210, 220, 230, and 240 and four high-frequency antenna units 250, 260, 270, and 280; but, the disclosure is not limited thereto. Any antenna device 100 having two or more antenna units falls within the scope to be protected by the disclosure.

In some embodiments, the antenna unit 210 includes a radiator 210*a* disposed on a first surface 293*a* of the substrate 293 and a radiator 210*b* disposed on a second surface 293*b* of the substrate 293. The antenna unit 220 includes a radiator 220*a* disposed on the first surface 293*a* of the substrate 293 and a radiator 220*b* disposed on the second surface 293*b* of the substrate 293. The antenna unit 230 includes a radiator 230*a* disposed on the first surface 293*a* of the substrate 293 and a radiator 230*b* disposed on the second surface 293*b* of the substrate 293. The antenna unit 240 includes a radiator 240*a* disposed on the first surface 293*a* of the substrate 293 and a radiator 240*b* disposed on the second surface 293*b* of the substrate 293. The antenna unit 250 includes a radiator 250*a* disposed on the first surface 293*a* of the substrate 293 and a radiator 250*b* disposed on the second surface 293*b* of the substrate 293. The antenna unit 260 includes a radiator 260*a* disposed on the first surface 293*a* of the substrate 293 and a radiator 260*b* disposed on the second surface 293*b* of the substrate 293. The antenna unit 270 includes a radiator 270*a* disposed on the first surface 293*a* of the substrate 293 and a radiator 270*b* disposed on the second surface 293*b* of the substrate 293. The antenna unit 280 includes a radiator 280*a* disposed on the first surface 293*a* of the substrate 293 and a radiator 280*b* disposed on the second surface 293*b* of the substrate 293.

In some embodiments, the transmitting line 201 is coupled to the radiator 210*a*, the radiator 250*a*, and the signal feeding point 291; the transmitting line 202 is coupled to the radiator 210*b*, the radiator 250*b*, and the antenna ground terminal 292; the transmitting line 211 is coupled to the radiator 240*a*, the radiator 280*a* and the signal feeding point 291; the transmitting line 212 is coupled to the radiator 240*b*, the radiator 280*b* and the antenna ground terminal 292; the transmitting line 221 is coupled to the radiator 230*a*, the radiator 270*a* and the signal feeding point 291; the transmitting line 222 is coupled to the radiator 230*b*, the radiator 270*b*, and the antenna ground terminal 292; the transmitting line 231 is coupled to the radiator 220*a*, the radiator 260*a*, and the signal feeding point 291; the transmitting line 232 is coupled to the radiator 220*b*, the radiator 260*b*, and antenna ground terminal 292.

In some embodiments, the signal feeding point 291 is disposed at the intersection of the transmitting lines 201, 211, 221, and 231, and the antenna ground terminal 292 is disposed at the intersection of the transmitting lines 202, 212, 222, and 232, but is not limited thereto. The signal feeding point 291 and the antenna ground terminal 292 may be disposed on the substrate 293 or any position outside the substrate 293 that is connected to the antenna units 210, 220, 230, 240, 250, 260, 270, and 280.

In some embodiments, the antenna units 210, 220, 230, 240, 250, 260, 270, and 280 operate as transmitting antennas for receiving radio frequency (RF) signals from the signal feeding point 291, such that the antenna device 100 generates a radiation pattern, wherein the direction of the radiation pattern extends outwardly around the signal feeding point 291. In some embodiments, the antenna units 210, 220, 230, 240, 250, 260, 270, and 280 operate as receiving antennas for receiving wireless signals from a user and establishing wireless signal channels accordingly. In some embodiments, the antenna units 250, 260, 270, and 280 are configured to generate an RF signals that operates at a first frequency (e.g., 5.5 GHz), and the antenna units 210, 220, 230, and 240 are configured to generate RF signals that operates at a second frequency (e.g., 2.45 GHz), and the first frequency is greater than the second frequency.

In some embodiments, the antenna units 210, 220, 230, 240, 250, 260, 270, and 280 may be implemented by planar inverted f antenna (PIFA), dipole antenna, and loop antenna, but is not limited thereto, and any circuit element suitable for implementing the horizontally polarized antenna unit falls within the scope of the disclosure.

In some embodiments, one of the antenna units 210, 220, 230, and 240 is arranged in an F shape with the corresponding antenna unit of the antenna units 250, 260, 270, and 280, and the corresponding transmission line of the transmitting lines 201, 202, 211, 212, 221, 222, 231, and 232. For example, the radiator 210*a* of the antenna unit 210, the radiator 250*a* of the antenna unit 250, and the transmitting line 201 are arranged in an F shape. The radiator 210*b* of the antenna unit 210, the radiator 250*b* of the antenna unit 250, and the transmitting line 202 are arranged in an F shape. The radiator 220*a* of the antenna unit 220, the radiator 260*a* of the antenna unit 260, and the transmitting line 231 are arranged in an F shape. The radiator 220*b* of the antenna unit 220, the radiator 260*b* of the antenna unit 260, and the transmitting line 232 are arranged in an F shape. The radiator 230*a* of the antenna unit 230, the radiator 270*a* of the antenna unit 270, and the transmitting line 221 are arranged in an F shape. The radiator 230*b* of the antenna unit 230, the radiator 270*b* of the antenna unit 270, and the transmitting line 222 are arranged in an F shape. The radiator 240*a* of the antenna unit 240, the radiator 280*a* of the antenna unit 280, and the transmitting line 211 are arranged in an F shape. The radiator 240*a* of the antenna unit 240, the radiator 280*a* of the antenna unit 280, and the transmitting line 212 are arranged in an F shape.

In some embodiments, the reflecting units 251, 252, 253, and 254 are configured to adjust a radiation pattern of the antenna units 210, 220, 230, 240, 250, 260, 270, and 280. For example, the reflecting unit 251 and the reflecting unit 252 are configured to adjust the radiation pattern corresponding to the antenna unit 240 and the antenna unit 280; the reflecting unit 252 and the reflecting unit 253 are configured to adjust the radiation pattern corresponding to the antenna unit 230 and the antenna unit 270; the reflecting unit 253 and the reflecting unit 254 are configured to adjust the radiation pattern corresponding to the antenna unit 220 and the antenna unit 260; the reflecting unit 254 and the reflecting unit 251 are configured to adjust the radiation pattern corresponding to the antenna unit 210 and the antenna unit 250, such that the respective radiation patterns of the antenna units 210, 220, 230, 240, 250, 260, 270, and 280 have directivity. In other embodiments, the shapes of the reflecting units 251, 252, 253, and 254 can be adjusted according to the X axis, the Y axis, and the Z axis.

In some embodiments, the reflecting units 251, 252, 253, and 254 are coupled to the substrate 293 and disposed on two sides of each of the antenna units 210, 220, 230, 240, 250, 260, 270, and 280. In some embodiments, the reflecting units 251, 252, 253, and 254 may be implemented by thin metal strips, but are not limited thereto, and any reflecting unit that can be used to implement an adjusted radiation pattern falls within the scope of the present disclosure.

In some embodiments, the transmitting lines 201, 202, 211, 212, 221, 222, 231, and 232 are configured to transmit the RF signals from the signal feeding point 291 to the antenna units 210, 220, 230, 240, 250, 260, 270, and 280. In some embodiments, the transmitting lines 201, 202, 211, 212, 221, 222, 231, and 232 may be implemented by metal wires, but are not limited thereto, and any wire that can be used to transmit RF signals falls within the scope of the present disclosure.

Figure 3A:
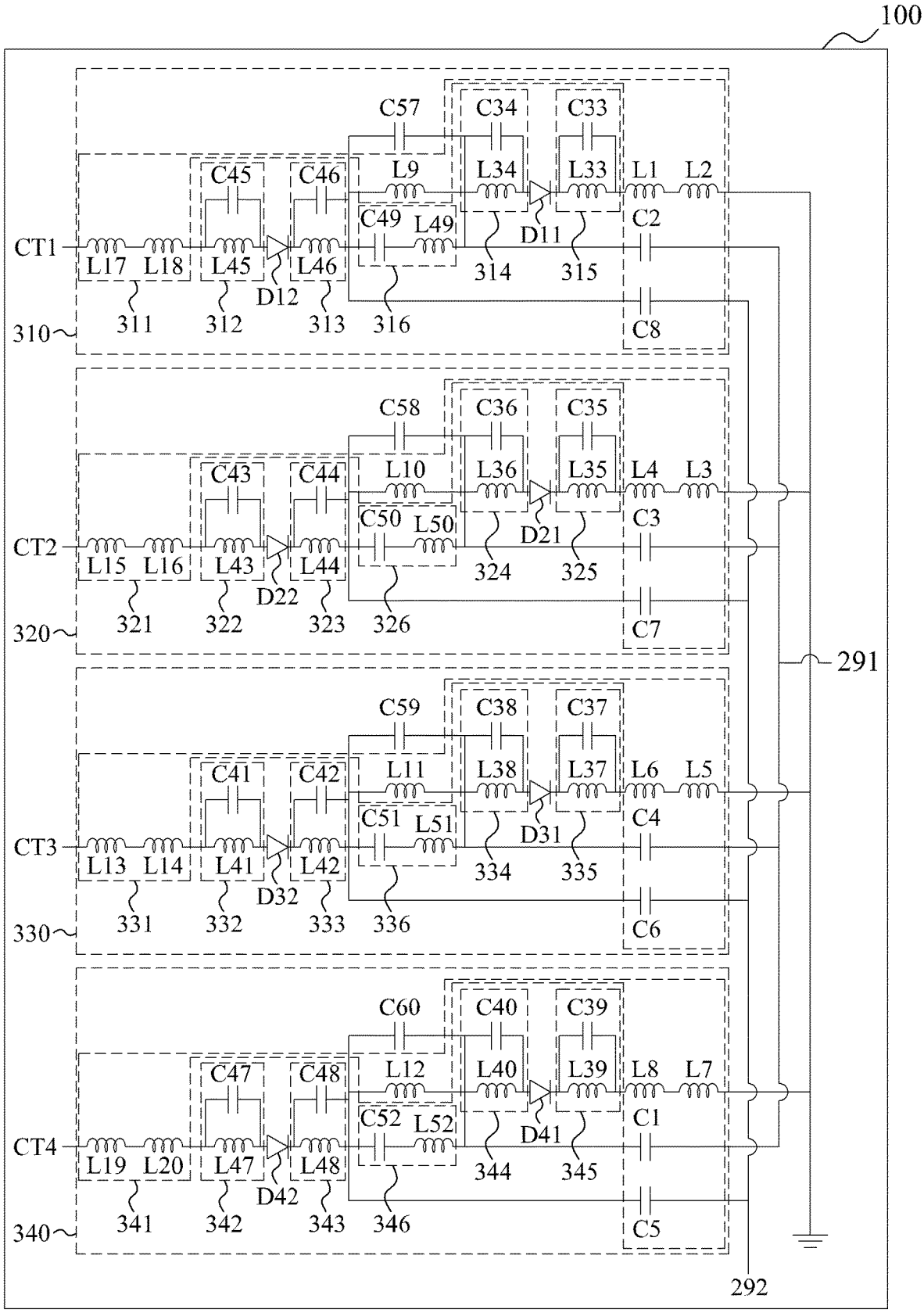
FIG. 3A is a partial circuit diagram of the antenna device in FIG. 2A and FIG. 2B according to some embodiments of the disclosure.
Figure 3B:
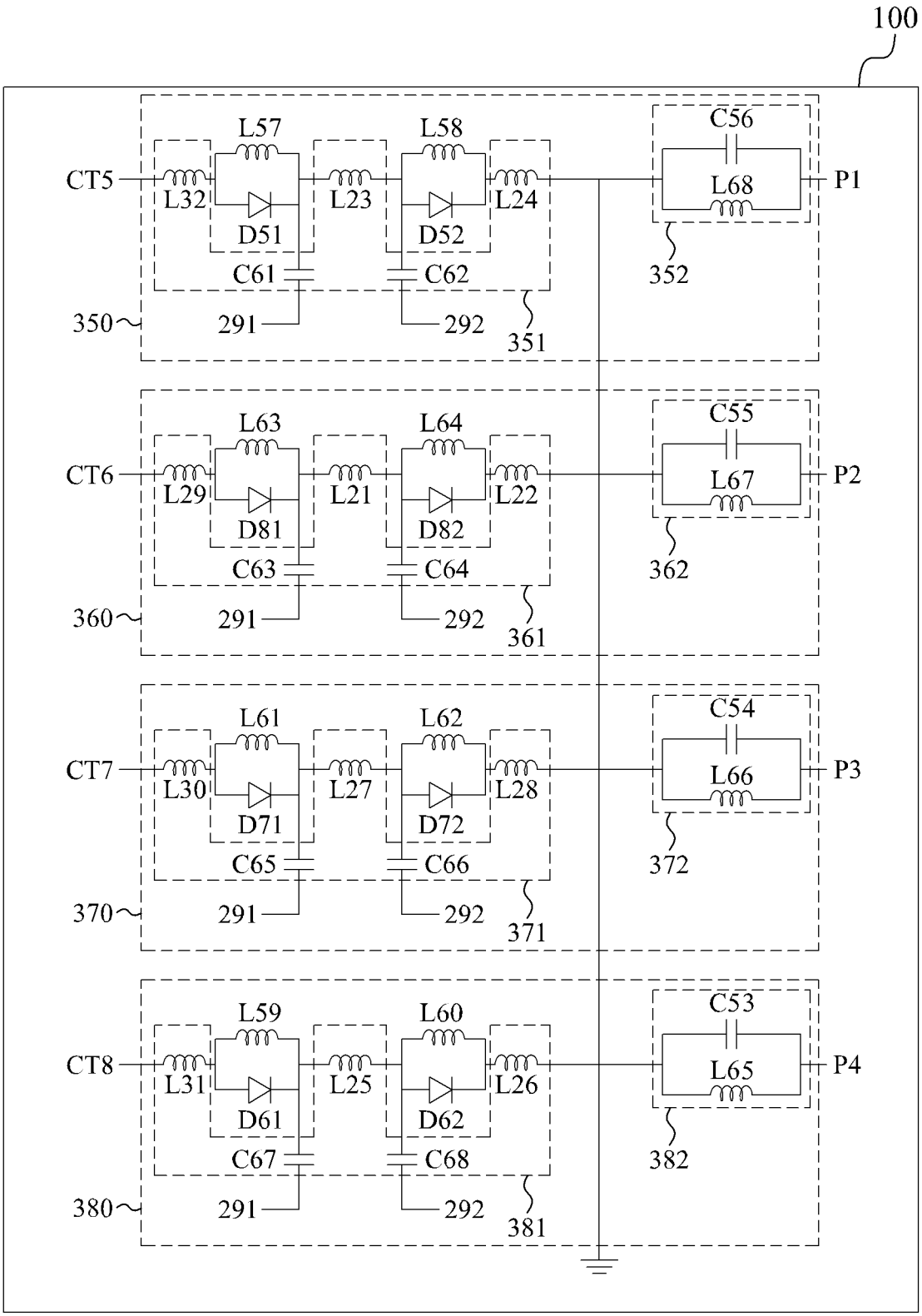
FIG. 3B is a partial circuit diagram of the antenna device in FIG. 2A and FIG. 2B according to some embodiments of the present disclosure.

Referring to FIG. 2A, FIG. 2B, FIG. 3A, and FIG. 3B. FIG. 3A and FIG. 3B are partial circuit diagrams of the antenna device 100 in FIG. 2A and FIG. 2B according to some embodiments of the disclosure.

In some embodiments, a control circuit (not shown) is configured to generate a plurality of control signals CT1, CT2, CT3, CT4, CT5, CT6, CT7, and CT8. In some embodiments, the control circuit (not shown) may be implemented by a server, a circuit, a central processor unit (CPU), a microprocessor (MCU) capable of computing, reading data, receiving signals or messages, transmitting signals or messages, or other electronic chip having the same functions.

In some embodiments, the antenna device 100 includes switching circuits 310, 320, 330, 340, 350, 360, 370, and 380 for selectively enabling at least one of the antenna units 210, 220, 230, 240, 250, 260, 270, and 280 according to a plurality of control signals CT1, CT2, CT3, CT4, CT5, CT6, CT7, and CT8 from the control circuit (not shown). In some embodiments, the actual configuration of the switching circuits 310, 320, 330, 340, 350, 360, 370, and 380 is as shown in FIG. 3A and FIG. 3B.

As shown in FIG. 3A and FIG. 3B, the antenna device 100 includes switching circuits 310, 320, 330, 340, 350, 360, 370, and 380, wherein the switching circuit 310 receives the control signal CT1, the switching circuit 320 receives the control signal CT2, the switching circuit 330 receives the control signal CT3, the switching circuit 340 receives the control signal CT4, the switching circuit 350 receives the control signal CT5, the switching circuit 360 receives the control signal CT6, the switching circuit 370 receives the control signal CT7, and the switching circuit 380 receives the control signal CT8.

In some embodiments, as shown in FIG. 3A and FIG. 3B, the switching circuit 310 includes a third switching element (the phase-shifting switch diode D11 in the embodiment of FIG. 3A) and a fourth switching element (the phase-shifting switch diode D12 in the embodiment of FIG. 3A), an impedance unit 311, filters 312, 313, 314, 315, 316 and a capacitor C57. The switching circuit 320 includes a third switching element (the phase-shifting switch diode D21 in the embodiment of FIG. 3A) and a fourth switching element (the phase-shifting switch diode D22 in the embodiment of FIG. 3A), an impedance unit 321, filters 322, 323, 324, 325, 326 and a capacitor C58. The switching circuit 330 includes a third switching element (the phase-shifting switch diode D31 in the embodiment of FIG. 3A) and a fourth switching element (the phase-shifting switch diode D32 in the embodiment of FIG. 3A), an impedance unit 331, filters 332, 333, 334, 335, 336 and a capacitor C59. The switching circuit 340 includes a third switching element (the phase-shifting switch diode D41 in the embodiment of FIG. 3A) and a fourth switching element (the phase-shifting switch diode D42 in the embodiment of FIG. 3A), an impedance unit 341, filters 342, 343, 344, 345, 346 and a capacitor C60. The switching circuit 350 includes a first switching element (the phase-shifting switch diode D51 in the embodiment of FIG. 3B) and a second switching element (the phase-shifting switch diode D52 in the embodiment of FIG. 3B), an impedance unit 351, a filter 352, and inductors L57 and L58. The switching circuit 360 includes a first switching element (the phase-shifting switch diode D81 in the embodiment of FIG. 3B) and a second switching element (the phase-shifting switch diode D82 in the embodiment of FIG. 3B), an impedance unit 361, a filter 362 and inductors L63 and L64.

The switching circuit 370 includes a first switching element (the phase-shifting switch diode D71 in the embodiment of FIG. 3B) and a second switching element (the phase-shifting switch diode D72 in the embodiment of FIG. 3B), an impedance unit 371, a filter 372, and inductors L61 and L62. The switching circuit 380 includes a first switching element (the phase-shifting switch diode D61 in the embodiment of FIG. 3B) and a second switching element (the phase-shifting switch diode D62 in the embodiment of FIG. 3B), an impedance unit 381, a filter 382, and inductors L59 and L60.

In some embodiments, the capacitors C57, C58, C59, and C60 included in the switching circuits 310, 320, 330, and 340, respectively, are configured to improve the impedance of low-frequency matching.

In some embodiments, the inductor L57 in the switching circuit 350 is connected in parallel with the phase-shifting switch (PIN) diode D51, the inductor L58 is connected in parallel with the phase-shifting switch diode D52, the inductor L63 in the switching circuit 360 is connected in parallel with the phase-shifting switch diode D81, the inductor L64 is connected in parallel with the phase-shifting switch diode D82, the inductor L61 in the switching circuit 370 is connected in parallel with the phase-shifting switch diode D71, the inductor L62 is connected in parallel with the phase-shifting switch diode D72, the inductor L59 in the switching circuit 380 is connected in parallel with the phase-shifting switch diode D61, the inductor L60 is connected in parallel with phase-shifting switch diode D62. With the above configuration, when the phase-shifting switch diodes D51/D52/D81/D82/D71/D72/D61/D62 are off, they can form a high-frequency band stop filter with the corresponding inductors L57/L58/L63/L64/L61/L62/L59/L60. By using the above mechanism, when the phase-shifting switch diodes D51/D52/D81/D82/D71/D72/D61/D62 on two adjacent antenna units 250/260/270/280 are off and the phase-shifting switch diodes D51/D52/D81/D82/D71/D72/D61/D62 on other antenna units 250/260/270/280 are on, the high-frequency radiation pattern has the beam-forming.

In some embodiments, the phase-shifting switch diodes D11, D12, D21, D22, D31, D32, D41, D42, D51, D52, D81, D82, D71, D72, D61, and D62 in the switching circuits 310, 320, 330, 340, 350, 360, 370, and 380 are disposed on the antenna units 210, 220, 230, 240, 250, 260, 270, and 280 for blocking or conducting the RF signals to be transmitted from the signal feeding point 291 to the plurality of antenna units 210, 220, 230, 240, 250, 260, 270, 280. For example, the phase-shifting switch diode D1*l* and the phase-shifting switch diode D12 are configured to block the RF signals and prevent the RF signals from being transmitted to the radiator 210*a* through the transmitting line 201 and transmitted to the radiator 210*b* through the transmitting line 202 from the signal feeding point 291 when it is intended that the antenna unit 210 is turned off. The phase-shifting switch diode D21 and the phase-shifting switch diode D22 are configured to block the RF signals and prevent the RF signals from being transmitted to the radiator 220*a* through the transmitting line 231 and from being transmitted to the radiator 220*b* through the transmitting line 232 from the signal feeding point 291 when it is intended that the antenna unit 220 is turned off. The phase-shifting switch diode D31 and the phase-shifting switch diode D32 are configured to block the RF signals and prevent the RF signals from being transmitted to the radiator 230*a* through the transmitting line 221 and from being transmitted to the radiator 230*b* through the transmitting line 222 from the signal feeding point 291 when it is intended that the antenna unit 230 is turned off. The phase-shifting switch diode D41 and the phase-shifting switch diode D42 are configured to block the RF signals and prevent the RF signals from being transmitted to the radiator 240*a* through the transmitting line 211 and transmitted to the radiator 240*b* through the transmitting line 212 from the signal feeding point 291 when it is intended that the antenna unit 240 is turned off. The phase-shifting switch diode D51 and the phase-shifting switch diode D52 are configured to block the RF signals and prevent the RF signals from being transmitted to the radiator 250*a* through the transmitting line 201 and from being transmitted to the radiator 250*b* through the transmitting line 202 from the signal feeding point 291 when it is intend that the antenna unit 250 is turned off. The phase-shifting switch diode D61 and the phase-shifting switch diode D62 are configured to block the RF signals and prevent the RF signals from being transmitted to the radiator 260*a* through the transmitting line 231 and from being transmitted to the radiator 260*b* through the transmitting line 232 from the signal feeding point 291 when it is intended that the antenna unit 260 is turned off. The phase-shifting switch diode D71 and the phase-shifting switch diode D72 are configured to block the RF signals and prevent the RF signals from being transmitted to the radiator 270*a* through the transmitting line 221 and transmitted to the radiator 270*b* through the transmitting line 222 from the signal feeding point 291 when it is intended that the antenna unit 270 is turned off. The phase-shifting switch diode D81 and the phase-shifting switch diode D82 are configured to block the RF signals and prevent the RFs from being transmitted to the radiator 280*a* through the transmitting line 211 and transmitted to the radiator 280*b* through the transmitting line 212 from the signal feeding point 291 when it is intended that the antenna unit 280 is turned off.

In some embodiments, the filters 312, 313, 314, and 315 in the switching circuit 310 are configured to reduce the impact of the antenna unit 210 on the antenna unit 250; the filters 322, 323, 324, and 325 in the switching circuit 320 are configured to reduce the impact of the antenna unit 220 on the antenna unit 260; the filters 332, 333, 334, and 335 in the switching circuit 330 are configured to reduce the impact of the antenna unit 230 on the antenna unit 270; the filters 342, 343, 344, and 345 in the switching circuit 340 are configured to reduce the impact of the antenna unit 240 on the antenna unit 280. By setting the filters 322~325, 332~335 and 342~345 on the two sides of the corresponding phase-shifting switch diodes D11/D12/D21/D22/D31/D32/D41/D42, the extent to which the radiation pattern of the high-frequency antenna (i.e., antenna units 250/260/270/280) is affected can be effectively reduced.

In some embodiments, each of the filters 312-315, 322-325, 332-335, and 342-345 includes capacitors and inductors connected in parallel to form a band stop filter. For example, taking the switching circuit 310 as an example, the filter 312 includes the capacitor C45 and the inductor L45, and the capacitor C45 and the inductor L45 are connected in parallel; the filter 313 includes the capacitor C46 and the inductor L46, and the capacitor C46 and the inductor L46 are connected in parallel; the filter 314 includes the capacitor C34 and the inductor L34, and the capacitor C34 and the inductor L34 are connected in parallel; the filter 315 includes the capacitor C33 and the inductor L33, and the capacitor C33 and the inductor L33 are connected in parallel.

In some embodiments, the filters 316, 326, 336, and 346 are configured to separate the high-frequency signals and the low-frequency signals to allow the high frequency signals to pass. As shown in FIG. 2A and FIG. 2B, the filter 316 in the switching circuit 310 is disposed on the transmitting lines 201 and 202 for frequency division; the filter 326 in the switching circuit 320 is disposed on the transmitting lines 231 and 232 for frequency division; the filter 336 in the switching circuit 330 is disposed on the transmitting lines 221 and 222 for frequency division; the filter 346 in the switching circuit 340 is disposed on the transmitting lines 211 and 212 for frequency division.

In some embodiments, each of the filters 316/326/336/346 includes capacitors and inductors connected in series to form a band pass filter for high-frequency signals to pass. For example, the filter 316 includes the capacitor C49 and the inductor L49, and the capacitor C49 and the inductor L49 are connected in series; the filter 326 includes the capacitor C50 and the inductor L50, and the capacitor C50 and the inductor L50 are connected in series; the filter 336 includes the capacitor C51 and the inductor L51, and the capacitor C51 and the inductor L51 are connected in series; the filter 346 includes the capacitor C52 and the inductor L52, and the capacitor C52 and the inductor L52 are connected in series.

In some embodiments, as shown in FIG. 2A, FIG. 2B, and FIG. 3B, the filters 352, 362, 372, and 382 are disposed on reflecting units 251, 252, 253, and 254, respectively, such that the reflecting units 251, 252, 253, and 254 have two characteristics and simultaneously serve as the adjusting plate of the radiation patterns generated by the antenna units 210, 240, 230, 220 and the antenna units 250, 280, 270, 260.

In some embodiments, the filter 352 includes the capacitor C56 and the inductor L68, and the capacitor C56 and the inductor L68 are connected in parallel; the filter 362 includes the capacitor C55 and the inductor L67, and the capacitor C55 and the inductor L67 are connected in parallel; the filter 372 includes the capacitor C54 and the inductor L66, and the capacitor C54 and the inductor L66 are connected in parallel; the filter 382 includes the capacitor C53 and the inductor L65, and the capacitor C53 and the inductor L65 are connected in parallel.

In some embodiments, the impedance unit 311 includes inductors L17, L18, L9, L1, L2 and capacitors C2 and C8; the impedance unit 321 includes inductors L15, L16, L10, L4, L3 and capacitors C3 and C7; the impedance unit 331 includes inductors L13, L14, L11, L6, L5 and capacitors C4 and C6; the impedance unit 341 includes inductors L19, L20, L12, L8, L7 and capacitors C1 and C5.

In some embodiments, the inductors L1~L32 of the impedance units 311, 321, 331, 341, 351, 361, 371, and 381 serve as RF chokes. Specifically, the inductors L1~L32 serve to prevent the RF signals from interfering with each other. In some embodiments, the capacitors C1~C8 and C61~C68 of the impedance units 311, 321, 331, 341, 351, 361, 371, 381 serve as DC blocks. Specifically, the capacitors C1~C8 and C61~C68 serve to block mutual interferences among multiple control signals CT1, CT2, CT3, CT4, CT5, CT6, CT7 and CT8.

In some embodiments, as shown in FIG. 2A, the phase-shifting switch diodes D11, D21, D31, D41, D51, D61, D71, D81, the inductors L1~L12, L21~L28, L33~L40, L49~L52, L57, L59, L61, L63, L65~L68, and the capacitors C1~C4, C41~C48, C53~C60, C61, C63, C65, C67 are disposed on the first surface 293*a* of the substrate 293. In some embodiments, as shown in FIG. 2B, the phase-shifting switch diodes D5-D8, the inductors L13~L20, L29~L32, L41~L48, L58, L60, L62, L64, the capacitors C5~C8, C33~C40, C49~C52, C62, C64, C66, C68 are disposed on the second surface 293*b* of the substrate 293.

In some embodiments, as shown in FIG. 3A, the first terminal of the inductor L17 is configured to receive the control signal CT1, and the second terminal of the inductor L17 is coupled to the first terminal of the inductor L18, and the second terminal of the inductor L18 is coupled to the first terminal of the inductor L45 and the first terminal of the capacitor C45, the second terminal of the inductor L45 is coupled to the second terminal of the capacitor C45 and the first terminal of the phase-shifting switch diode D12, the second terminal of the phase-shifting switch diode D12 is coupled to the first terminal of the inductor L46 and the first terminal of the capacitor C46, the second terminal of the inductor L46 is coupled to the second terminal of the capacitor C46 and the first terminal of the capacitor C57, the first terminal of the inductor L9, the first terminal of the capacitor C49 and the first terminal of the capacitor C8, the second terminal of the capacitor C57 is coupled to the first terminal of the capacitor C34, the second terminal of the inductor L9, the first terminal of the inductor L34, the second terminal of the inductor L49 and the first terminal of the capacitor C2, the second terminal of the capacitor C49 is coupled to the first terminal of the inductor L49, the second terminal of the inductor L49 is coupled to the first terminal of the capacitor C2, the second terminal of the capacitor C2 is coupled to the signal feeding point 291 (also refer to the signal feeding point 291 in FIG. 2A), the second terminal of the capacitor C8 is coupled to the antenna ground terminal 292 (also refer to the antenna ground terminal 292 in FIG. 2B), the second terminal of the inductor L34 is coupled to the first terminal of the phase-shifting switch diode D11, the second terminal of the phase-shifting switch diode D11 is coupled to the first terminal of the inductor L33 and the first terminal of the capacitor C33, the second terminal of the inductor L33 is coupled to the second terminal of the capacitor C33 and the first terminal of the inductor L1, the second terminal of the inductor L1 is coupled to the first terminal of the inductor L2, and the second terminal of the inductor L2 is grounded.

In some embodiments, as shown in FIG. 3A, the first terminal of the inductor L15 is configured to receive the control signal CT2, and the second terminal of the inductor L15 is coupled to the first terminal of the inductor L16, the second terminal of the inductor L16 is coupled to the first terminal of the inductor L43 and the first terminal of the capacitor C43, the second terminal of the inductor L43 is coupled to the second terminal of the capacitor C43 and the first terminal of the phase-shifting switch diode D22, the second terminal of the phase-shifting switch diode D22 is coupled to the first terminal of the inductor L44 and the first terminal of the capacitor C44, the second terminal of the inductor L44 is coupled to the second terminal of the capacitor C44 and the first terminal of the capacitor C58, the first terminal of the inductor L10, the first terminal of the capacitor C50 and the first terminal of the capacitor C7, the second terminal of the capacitor C58 is coupled to the first terminal of the capacitor C36, the second terminal of the inductor L10, the first terminal of the inductor L36, the second terminal of the inductor L50 and the first terminal of the capacitor C3, the second terminal of the capacitor C50 is coupled to the first terminal of the inductor L50, the second terminal of the inductor L50 is coupled to the first terminal of the capacitor C3, the second terminal of the capacitor C3 is coupled to the signal feeding point 291 (as shown in FIG. 2A), the second terminal of the capacitor C7 is coupled to the antenna ground terminal 292 (as shown in FIG. 2B), the second terminal of the inductor L36 is coupled to the first terminal of the phase-shifting switch diode D21, the second terminal of the phase-shifting switch diode D21 is coupled to the first terminal of the inductor L35 and the first terminal of the capacitor C35, the second terminal of the inductor L35 is coupled to the second terminal of the capacitor C35 and the first terminal of the inductor L4, the second terminal of the inductor L4 is coupled to the first terminal of the inductor L3, and the second terminal of the inductor L3 is grounded.

In some embodiments, as shown in FIG. 3A, the first terminal of the inductor L13 is configured to receive the control signal CT3, and the second terminal of the inductor L13 is coupled to the first terminal of the inductor L14, the second terminal of the inductor L14 is coupled to the first terminal of the inductor L41 and the first terminal of the capacitor C41, the second terminal of the inductor L41 is coupled to the second terminal of the capacitor C41 and the first terminal of the phase-shifting switch diode D32, the second terminal of the phase-shifting switch diode D32 is coupled to the first terminal of the inductor L42 and the first terminal of the capacitor C42, the second terminal of the inductor L42 is coupled to the second terminal of the capacitor C42 and the first terminal of the capacitor C59, the first terminal of the inductor L11, the first terminal of the capacitor C51 and the first terminal of the capacitor C6, the second terminal of the capacitor C59 is coupled to the first terminal of the capacitor C38, the second terminal of the inductor L11, the first terminal of the inductor L38, the second terminal of the inductor L51 and the first terminal of the capacitor C4, the second terminal of the capacitor CM is coupled to the first terminal of the inductor L51, the second terminal of the inductor L51 is coupled to the first terminal of the capacitor C4, the second terminal of the capacitor C4 is coupled to the signal feeding point 291 (as shown in FIG. 2A), the second terminal of the capacitor C6 is coupled to the antenna ground terminal 292 (as shown in FIG. 2B), the second terminal of the inductor L38 is coupled to the first terminal of the phase-shifting switch diode D31, the second terminal of the phase-shifting switch diode D31 is coupled to the first terminal of the inductor L37 and the first terminal of the capacitor C37, the second terminal of the inductor L37 is coupled to the second terminal of the capacitor C37 and the first terminal of the inductor L6, the second terminal of the inductor L6 is coupled to the first terminal of the inductor L5, and the second terminal of the inductor L5 is connected to ground G.

In some embodiments, as shown in FIG. 3A, the first terminal of the inductor L19 is configured to receive the control signal CT4, and the second terminal of the inductor L19 is coupled to the first terminal of the inductor L20, the second terminal of the inductor L20 is coupled to the first terminal of the inductor L47 and the first terminal of the capacitor C47, the second terminal of the inductor L47 is coupled to the second terminal of the capacitor C47 and the first terminal of the phase-shifting switch diode D42, the second terminal of the phase-shifting switch diode D42 is coupled to the first terminal of the inductor L48 and the first terminal of the capacitor C48, the second terminal of the inductor L48 is coupled to the second terminal of the capacitor C48 and the first terminal of the capacitor C60, the first terminal of the inductor L12, the first terminal of the capacitor C52 and the first terminal of the capacitor C5, the second terminal of the capacitor C60 is coupled to the first terminal of the capacitor C40, the second terminal of the inductor L12, the first terminal of the inductor L40, the second terminal of the inductor L52 and the first terminal of the capacitor C1, the second terminal of the capacitor C52 is coupled to the first terminal of the inductor L52, the second terminal of the inductor L52 is coupled to the first terminal of the capacitor C1, the second terminal of the capacitor C1 is coupled to the signal feeding point 291 (as shown in FIG. 2A), the second terminal of the capacitor C5 is coupled to the antenna ground terminal 292 (as shown in FIG. 2B), the second terminal of the inductor L40 is coupled to the first terminal of the phase-shifting switch diode D41, the second terminal of the phase-shifting switch diode D41 is coupled to the first terminal of the inductor L39 and the first terminal of the capacitor C39, the second terminal of the inductor L39 is coupled to the second terminal of the capacitor C39 and the first terminal of the inductor L8, the second terminal of the inductor L8 is coupled to the first terminal of the inductor L7, and the second terminal of the inductor L7 is connected to the ground G.

In some embodiments, as shown in FIG. 3B, the first terminal of the inductor L32 is configured to receive the control signal CT5, and the second terminal of the inductor L32 is coupled to the first terminal of the inductor L57 and the first terminal of the phase-shifting switch diode D51, the second terminal of the phase-shifting switch diode D51 is coupled to the second terminal of the inductor L57, the first terminal of the capacitor C61 and the first terminal of the inductor L23, the second terminal of the capacitor C61 is coupled to the signal feeding point 291 (as shown in FIG. 2A), the second terminal of the inductor L23 is coupled to the first terminal of the inductor L58, the first terminal of the phase-shifting switch diode D52 and the first terminal of the capacitor C62, the second terminal of the capacitor C62 is coupled to the antenna ground terminal 292 (as shown in FIG. 2B), the second terminal of the phase-shifting switch diode D52 is coupled to the second terminal of the inductor L58 and the first terminal of the inductor L24, the second terminal of the inductor L24 is connected to the ground G and coupled to the first terminal of the capacitor C56 and the first terminal of the inductor L68, the second terminal of the capacitor C56 is coupled to the second terminal of the inductor L68, and the coupling point is represented as a node P1 in FIG. 2A.

In some embodiments, as shown in FIG. 3B, the first terminal of the inductor L29 is configured to receive the control signal CT6, and the second terminal of the inductor L29 is coupled to the first terminal of the inductor L63 and the first terminal of the phase-shifting switch diode D81, the second terminal of the phase-shifting switch diode D81 is coupled to the second terminal of the inductor L63, the first terminal of the capacitor C63 and the first terminal of the inductor L21, the second terminal of the capacitor C63 is coupled to the signal feeding point 291 (as shown in FIG. 2A), the second terminal of the inductor L21 is coupled to the first terminal of the inductor L64, the first terminal of the phase-shifting switch diode D82 and the first terminal of the capacitor C64, the second terminal of the capacitor C64 is coupled to the antenna ground terminal 292 (as shown in FIG. 2B), the second terminal of the phase-shifting switch diode D82 is coupled to the second terminal of the inductor L64 and the first terminal of the inductor L22, the second terminal of the inductor L22 is connected to the ground G and coupled to the first terminal of the capacitor C55 and the first terminal of the inductor L67, the second terminal of the capacitor C55 is coupled to the second terminal of the inductor L67, and the coupling point is represented as a node P2 in FIG. 2A.

In some embodiments, as shown in FIG. 3B, the first terminal of the inductor L30 is configured to receive the control signal CT7, and the second terminal of the inductor L30 is coupled to the first terminal of the inductor L61 and the first terminal of the phase-shifting switch diode D71, the second terminal of the phase-shifting switch diode D71 is coupled to the second terminal of the inductor L61, the first terminal of the capacitor C65 and the first terminal of the inductor L27, the second terminal of the capacitor C65 is coupled to the signal feeding point 291 (as shown in FIG. 2A), the second terminal of the inductor L27 is coupled to the first terminal of the inductor L62, the first terminal of the phase-shifting switch diode D72 and the first terminal of the capacitor C66, the second terminal of the capacitor C66 is coupled to the antenna ground terminal 292 (as shown in FIG. 2B), the second terminal of the phase-shifting switch diode D72 is coupled to the second terminal of the inductor L62 and the first terminal of the inductor L28, the second terminal of the inductor L28 is connected to the ground G and coupled to the first terminal of the capacitor C54 and the first terminal of the inductor L66, the second terminal of the capacitor C54 is coupled to the second terminal of the inductor L66, and the coupling point is represented as a node P3 in FIG. 2A.

In some embodiments, as shown in FIG. 3B, the first terminal of the inductor L31 is configured to receive the control signal CT8, and the second terminal of the inductor L31 is coupled to the first terminal of the inductor L59 and the first terminal of the phase-shifting switch diode D61, the second terminal of the phase-shifting switch diode D61 is coupled to the second terminal of the inductor L59, the first terminal of the capacitor C67 and the first terminal of the inductor L25, the second terminal of the capacitor C67 is coupled to the signal feeding point 291 (as shown in FIG. 2A), the second terminal of the inductor L25 is coupled to the first terminal of the inductor L60, the first terminal of the phase-shifting switch diode D62 and the first terminal of the capacitor C68, the second terminal of the capacitor C68 is coupled to the antenna ground terminal 292 (as shown in FIG. 2B), the second terminal of the phase-shifting switch diode D62 is coupled to the second terminal of the inductor L60 and the first terminal of the inductor L26, the second terminal of the inductor L26 is connected to the ground G and coupled to the first terminal of the capacitor C53 and the first terminal of the inductor L65, the second terminal of the capacitor C53 is coupled to the second terminal of the inductor L65, and the coupling point is represented as a node P4 in FIG. 2A.

In some embodiments, the antenna device 100 has two operating frequencies, such as a high-frequency and a low-frequency and the two respective operating frequencies correspond to an omnidirectional mode and a directional mode. In practical applications, the omnidirectional mode or the directional mode of the low-frequency band is switched from one to another by enabling at least two of the plurality of phase-shifting switch diodes D11, D12, D21, D22, D31, D32, D41, and D42 in the antenna device 100. The omnidirectional mode or directional mode of the high-frequency band is switched from one to another by enabling at least two of the plurality of phase-shifting switch diodes D51, D52, D81, D82, D71, D72, D61, and D62 in the antenna device 100.

In some embodiments, when it is intended that the antenna device 100 operates in a low-frequency omnidirectional mode, all of the phase-shifting switch diodes D11, D12, D21, D22, D31, D32, D41, and D42 are turned on to generate a low-frequency omnidirectional radiation pattern. When it is intended that the antenna device 100 operates in a low-frequency directional mode, the phase-shifting switch diodes D31, D32, D41, and D42 are on, and the phase-shifting switch diodes D11, D12, D21, and D22 are off, such that the entire energy of the low frequency is aggregated at the antenna units 230 and 240, and the radiation pattern propagating towards the lower left of FIG. 2A (that is, the direction of 315 degrees as shown in FIG. 1) is generated. When the phase-shifting switch diodes D11, D12, D41, and D42 are on, and the phase-shifting switch diodes D21, D22, D31, and D32 are off, the entire energy of the low frequency is aggregated at the antenna units 210 and 240, and the radiation pattern propagating towards the upper left of FIG. 2A (i.e., the direction of 225 degrees as shown in FIG. 1) is generated. When the phase-shifting switch diodes D11, D12, D21, and D22 are on, and the phase-shifting switch diodes D31, D32, D41, and D42 are off, the entire energy of the low frequency is aggregated at the antenna units 210 and 220, and the radiation pattern propagating towards the upper right of FIG. 2A (i.e., the direction of 135 degrees as shown in FIG. 1) is generated. When the phase-shifting switch diodes D21, D22, D31, and D32 are on, and the phase-shifting switch diodes D11, D12, D41, and D42 are off, the entire energy of the low frequency is aggregated at the antenna units 220 and 230, and the radiation pattern propagating towards the lower right of FIG. 2A (that is, the direction of 45 degrees as shown in FIG. 1) is generated.

It can be seen in the above embodiment that when the antenna device 100 switches radiation patterns at the low frequency, the phase-shifting switch diodes on at least two adjacent antenna units among the antenna units 210, 220, 230, and 240 are on. It is because if only the phase-shifting switch diodes on one of the antenna units 210, 220, 230, and 240 are on, the return loss would be too large. However, only enabling one of the antenna units 210, 220, 230, and 240 also falls within the scope of the present disclosure.

In some embodiments, the low-frequency radiation patterns are unaffected whether the antenna device 100 operates in a high-frequency omnidirectional mode or a directional mode. In detail, whether each of the phase-shifting switch diodes D51, D52, D81, D82, D71, D72, D61, and D62 is on or off, it does not impact the low-frequency radiation patterns.

In some embodiments, when it is intended that the antenna device 100 operates in a high-frequency omnidirectional mode, all of the phase-shifting switch diodes D51, D52, D61, D62, D71, D72, D81, and D82 are on to generate a high-frequency omnidirectional radiation pattern. When it is intended that the antenna device 100 operates in a high-frequency directional mode, the phase-shifting switch diodes D71, D72, D81, and D82 are on, and the phase-shifting switch diodes D51, D52, D61, and D62 are off, such that the entire energy of the high frequency is aggregated at the antenna units 270 and 280, and the radiation pattern propagating towards the lower left of FIG. 2A (that is, the direction of 315 degrees as shown in FIG. 1) is generated. When the phase-shifting switch diodes D51, D52, D81, and D82 are on, and the phase-shifting switch diodes D61, D62, D71, D72 are off, the entire energy of the high frequency is aggregated at the antenna units 250 and 280, and the radiation pattern propagating towards the upper left of FIG. 2A (i.e., the direction of 225 degrees as shown in FIG. 1) is generated. When the phase-shifting switch diodes D51, D52, D61, and D62 are on, and the phase-shifting switch diodes D71, D72, D81, and D82 are off, the entire energy of the high frequency is aggregated at the antenna units 250 and 260, and the radiation pattern propagating towards the upper right of FIG. 2A (that is, the direction of 135 degrees as shown in FIG. 1) is generated. When the phase-shifting switch diodes D61, D62, D71, and D72 are on, and the phase-shifting switch diodes D51, D52, D81 and D82 are off, the entire energy of the high frequency is aggregated at the antenna units 260 and 270, and the radiation pattern propagating towards the lower right of FIG. 2A (that is, the direction of 45 degrees as shown in FIG. 1) is generated.

It can be seen in the above embodiment that when the antenna device 100 switches radiation patterns at the high-frequency, the phase-shifting switch diodes on at least two adjacent antenna units among the antenna units 250, 260, 270, and 280 are on. It is because if only the phase-shifting switch diodes on one of the antenna units 250, 260, 270, and 280 are on, the return loss would be too large. However, only enabling one of the antenna units 250, 260, 270, and 280 also falls within the scope of the present disclosure.

In practical applications, when the antenna device 100 detects that the user enters a specific beam footprint, the antenna device 100 turns on multiple internal switches (for example, phase-shifting switch diodes D11, D12, D21, D22, D31, D32, D41, D42, D51, D52, D61, D62, D71, D72, D81, D82) to generate dual-frequency omnidirectional radiation pattern. Then, according to the received signal strength indicator (RSSI) received from the plurality of antenna units 210, 220, 230, 240, 250, 260, 270, and 280, some of the multiple internal switches (for example, the phase-shifting switch diodes D11, D12, D21, D22, D31, D32, D41, D42, D51, D52, D61, D62, D71, D72, D81, D82) are turned on to adjust the beamforming to point at the user, so that the data rate between the antenna device 100 and the user reaches the maximum.

Figure 4A:
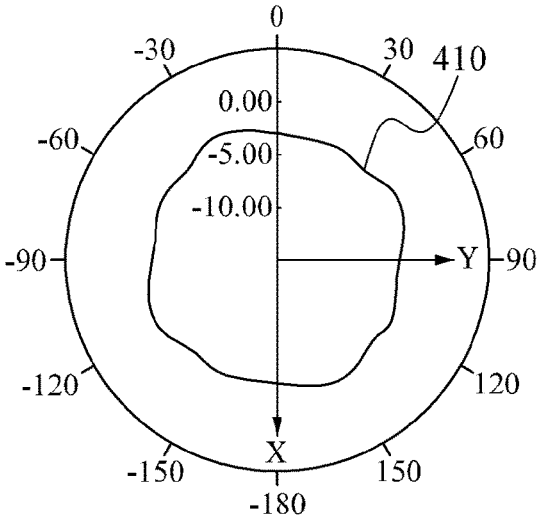
FIG. 4A is a high-frequency radiation pattern diagram of an antenna device according to some embodiments of the present disclosure.
Figure 4B:
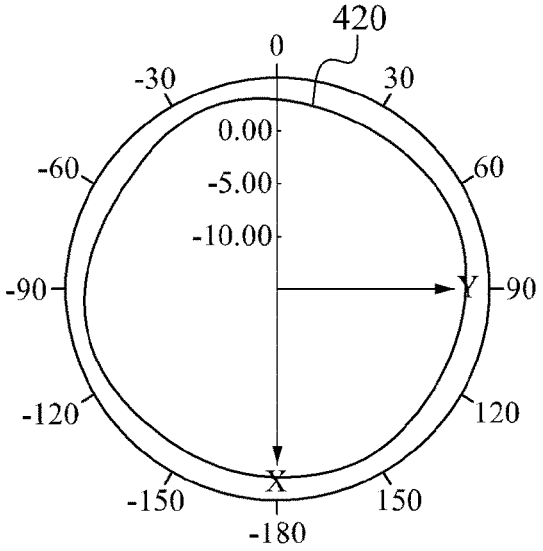
FIG. 4B is a high-frequency radiation pattern diagram of an antenna device according to some embodiments of the present disclosure.
Figure 4C:
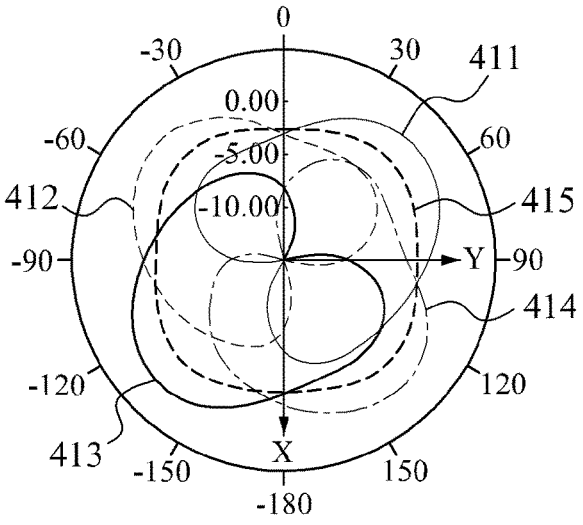
FIG. 4C shows a low-frequency radiation pattern diagram of the antenna device with a high-frequency radiation pattern shown in FIG. 4A according to some embodiments of the present disclosure.

Referring to FIG. 4A and FIG. 4C, FIG. 4A illustrates a high-frequency radiation pattern diagram of the antenna device 100 in the embodiments of FIG. 1 to FIG. 3B in an operation mode, and FIG. 4C shows a low-frequency radiation pattern diagram of the antenna device 100 in the embodiments shown in FIG. 1 to FIG. 3B in the same operation mode of FIG. 4A. In some embodiments, the operation modes illustrated in FIG. 4A and FIG. 4C are the high-frequency omnidirectional mode on θ=90° plane. On this occasion, the high-frequency radiation pattern diagram of the antenna device 100 is the radiation pattern 410 (as shown in FIG. 4A), and the low-frequency radiation pattern diagram of the antenna device 100 is the radiation pattern 411-415 (as shown in FIG. 4C).

As shown in FIG. 4C, the low-frequency radiation pattern diagram of the antenna device 100 includes the radiation pattern 411 of the antenna device 100 when the phase-shifting switch diodes D31, D32, D41, and D42 are off, the radiation pattern 412 of the antenna device 100 when the phase-shifting switch diodes D21, D22, D31, and D32 are off, the radiation pattern 413 of the antenna device 100 when the phase-shifting switch diodes D11, D12, D21, and D22 are off, the radiation pattern 414 of the antenna device 100 when the phase-shifting switch diodes D11, D12, D41, and D42 are off, and the radiation pattern 415 of the antenna device 100 when all of the phase-shifting switch diodes D11, D12, D21, D22, D31, D32, D41, and D42 are on. Based on the above, it can be seen that when the antenna device 100 operates in a high-frequency omnidirectional mode (that is, the antenna units 250, 260, 270, and 280 are all enabled), the operation of the low-frequency directional mode is not affected by the high-frequency radiation pattern 410 and still maintains good directivity.

Figure 4D:
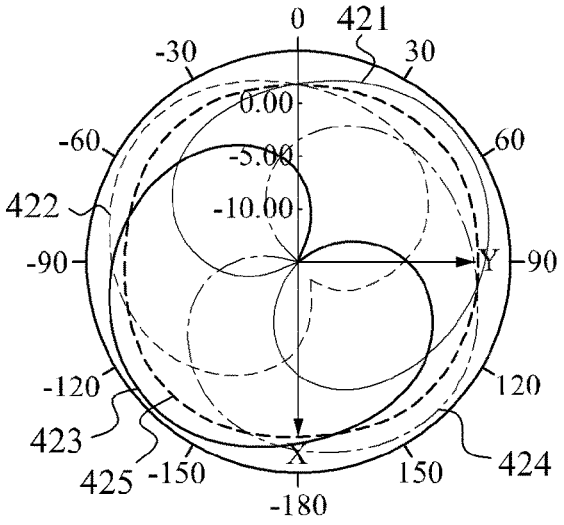
FIG. 4D shows a low-frequency radiation pattern diagram of the antenna device with a high-frequency radiation pattern shown in FIG. 4B according to some embodiments of the present disclosure.

Referring to FIG. 4B and FIG. 4D, FIG. 4B is a high-frequency radiation pattern diagram of the antenna device 100 in another operation mode according to the embodiments of FIG. 1 to FIG. 3B, and FIG. 4D shows a low-frequency radiation pattern diagram of the antenna device 100 in the same operation mode of FIG. 4B according to the embodiments shown in FIG. 1 to FIG. 3B. In some embodiments, the operation modes illustrated in FIG. 4B and FIG. 4D are the high-frequency omnidirectional mode on θ=60° plane. On this occasion, the high-frequency radiation pattern diagram of the antenna device 100 has the radiation pattern 420 (as shown in FIG. 4B), and the low-frequency radiation pattern diagram of the antenna device 100 has the radiation patterns 421-425 (as shown in FIG. 4D).

As shown in FIG. 4D, the low-frequency radiation pattern diagram of the antenna device 100 includes the radiation pattern 421 of the antenna device 100 when the phase-shifting switch diodes D31, D32, D41, and D42 are off, the radiation pattern 422 of the antenna device 100 when the phase-shifting switch diodes D21, D22, D31, and D32 are of, the radiation pattern 423 of the antenna device 100 when the phase-shifting switch diodes D11, D12, D21, and D22 are off, the radiation pattern 424 of the antenna device 100 when the phase-shifting switch diodes D11, D12, D41, and D42 are off, and the radiation pattern 425 of the antenna device 100 when all of the phase-shifting switch diodes D11, D12, D21, D22, D31, D32, D41, and D42 are on. Based on the above, it can be seen that when the antenna device 100 operates in the high-frequency omnidirectional mode (that is, the antenna units 250, 260, 270, and 280 are all on), the operation of the low-frequency directional mode is not affected by the high-frequency radiation pattern 420 and still maintains good directivity.

Figure 5A:
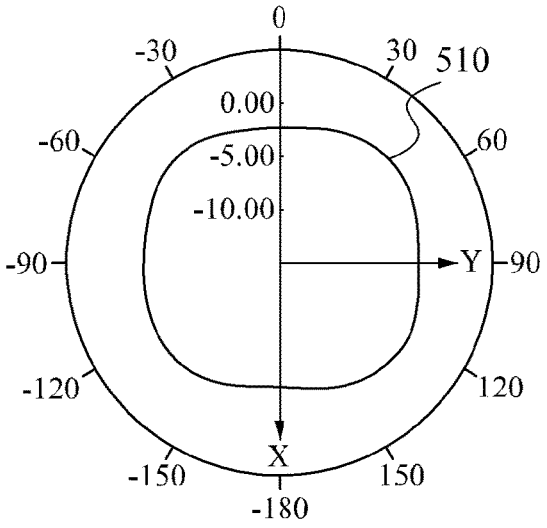
FIG. 5A shows a low-frequency radiation pattern diagram of an antenna device according to some embodiments of the present disclosure.
Figure 5B:
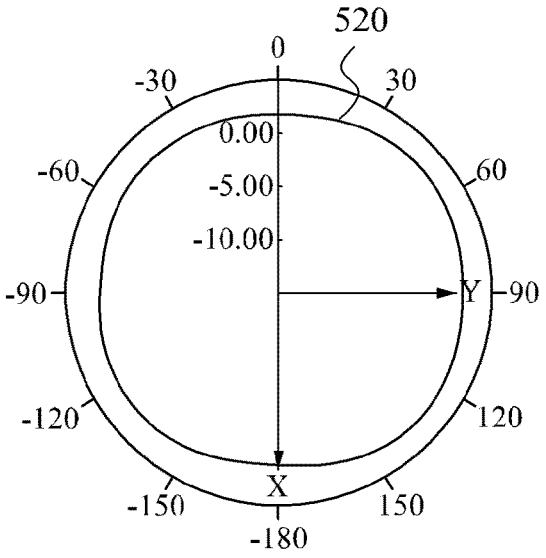
FIG. 5B shows a low-frequency radiation pattern diagram of an antenna device according to some embodiments of the present disclosure.
Figure 5C:
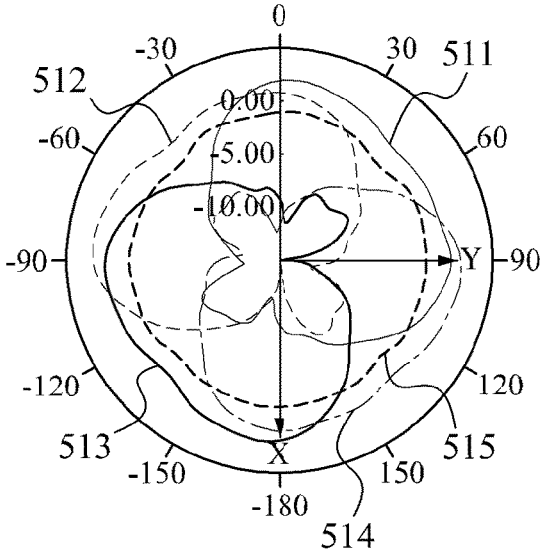
FIG. 5C shows a high-frequency radiation pattern diagram of the antenna device with a low-frequency radiation pattern shown in FIG. 5A according to some embodiments of the present disclosure.

Referring to FIG. 5A and FIG. 5C, FIG. 5A is a low-frequency radiation pattern diagram of the antenna device 100 in an operation mode according to the embodiments shown in FIG. 1 to FIG. 3B, and FIG. 5C is a high-frequency radiation pattern diagram of the antenna device 100 in the same operation mode as in FIG. 5A according to the embodiments shown in FIG. 1 to FIG. 3B. In some embodiments, the operation modes illustrated in FIG. 5A and FIG. 5C are the low-frequency omnidirectional mode on θ=90° plane. On this occasion, the low-frequency radiation pattern diagram of the antenna device 100 has the radiation pattern 510 (as shown in FIG. 5A), and the high-frequency radiation pattern diagram of the antenna device 100 has the radiation pattern 511-515 (as shown in FIG. 5C).

As shown in FIG. 5C, the high-frequency radiation pattern diagram of the antenna device 100 includes the radiation pattern 511 of the antenna device 100 when the phase-shifting switch diodes D71, D72, D81, and D82 are off, the radiation pattern 512 of the antenna device 100 when the phase-shifting switch diodes D61, D62, D71, and D72 are off, the radiation pattern 513 of the antenna device 100 when the phase-shifting switch diodes D51, D52, D61, and D62 are off, the radiation pattern 514 of the antenna device 100 when the phase-shifting switch diodes D51, D52, D81, and D82 are off, and the radiation pattern 515 of the antenna device 100 when all of the phase-shifting switch diodes D51, D52, D61, D62, D71, D72, D81, and D82 are on. Based on the above, it can be seen that when the antenna device 100 operates in the low-frequency omnidirectional mode (that is, the antenna units 210, 220, 230, and 240 are all on), the operation of the high-frequency directional mode is not affected by the low-frequency radiation pattern 510 and still maintains good directivity.

Figure 5D:
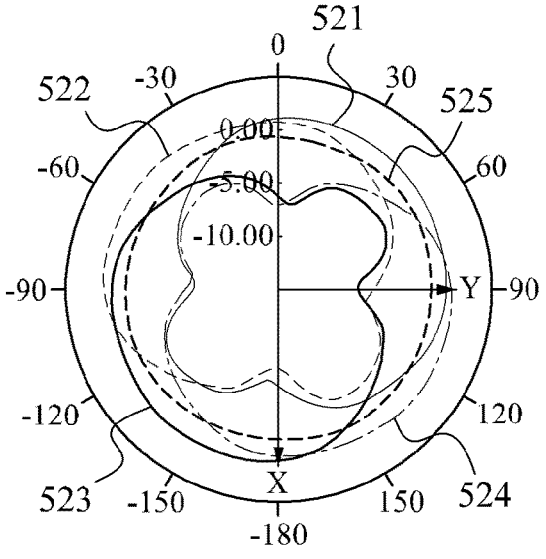
FIG. 5D shows a high-frequency radiation pattern diagram of the antenna device with a low-frequency radiation pattern shown in FIG. 5B according to some embodiments of the present disclosure.

Referring to FIG. 5B and FIG. 5D, FIG. 5B is a low-frequency radiation pattern diagram of the antenna device 100 in another operation mode according to the embodiments shown in FIG. 1 to FIG. 3B, and FIG. 5D is a high-frequency radiation pattern diagram of the antenna device 100 in the same operation mode as in FIG. 5A according to the embodiments shown in FIG. 1 to FIG. 3B. In some embodiments, the operation modes illustrated in FIG. 5B and FIG. 5D are the low-frequency omnidirectional mode on θ=60° plane. On this occasion, the low-frequency radiation pattern diagram of the antenna device 100 has the radiation pattern 520 (as shown in FIG. 5B), and the high-frequency radiation pattern diagram of the antenna device 100 has the radiation pattern 521-525 (as shown in FIG. 5D).

As shown in FIG. 5D, the high-frequency radiation pattern diagram of the antenna device 100 includes the radiation pattern 521 of the antenna device 100 when the phase-shifting switch diodes D71, D72, D81, and D82 are off, the radiation pattern 522 of the antenna device 100 when the phase-shifting switch diodes D61, D62, D71, and D72 are off, the radiation pattern 523 of the antenna device 100 when the phase-shifting switch diodes D51, D52, D61, and D62 are off, the radiation pattern 524 of the antenna device 100 when the phase-shifting switch diodes D51, D52, D81, and D82 are off, and the radiation pattern 525 of the antenna device 100 when all of the phase-shifting switch diodes D51, D52, D61, D62, D71, D72, D81, and D82 are on. Based on the above, it can be seen that when the antenna device 100 operates in the low-frequency omnidirectional mode (that is, the antenna units 210, 220, 230, and 240 are all on), the operation of the high-frequency directional mode is not affected by the low-frequency radiation pattern 520 and still maintains good directivity.

Figure 6A:
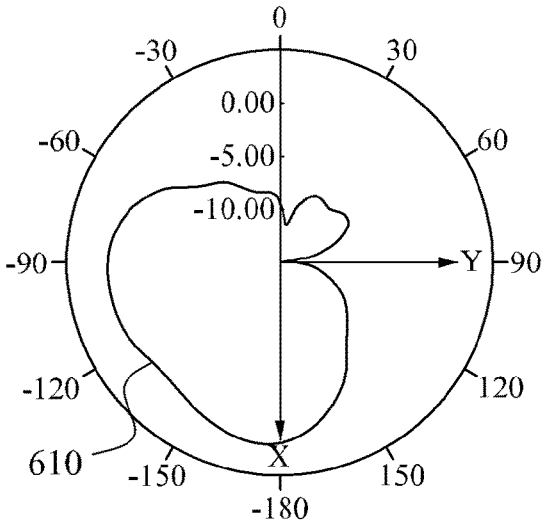
FIG. 6A shows a high-frequency radiation pattern diagram of an antenna device according to some embodiments of the present disclosure.
Figure 6B:
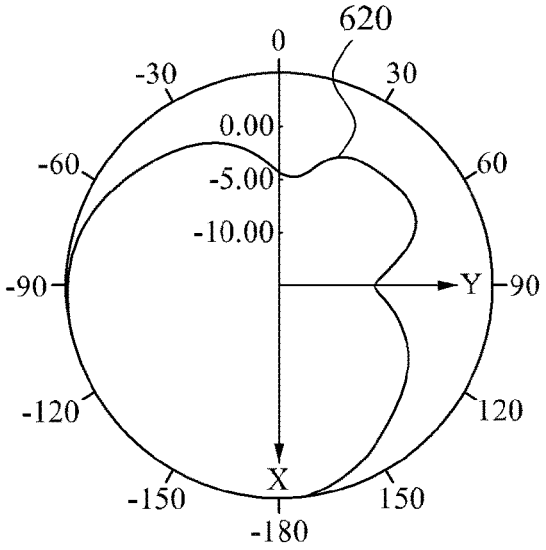
FIG. 6B shows a high-frequency radiation pattern diagram of an antenna device according to some embodiments of the present disclosure.
Figure 6C:
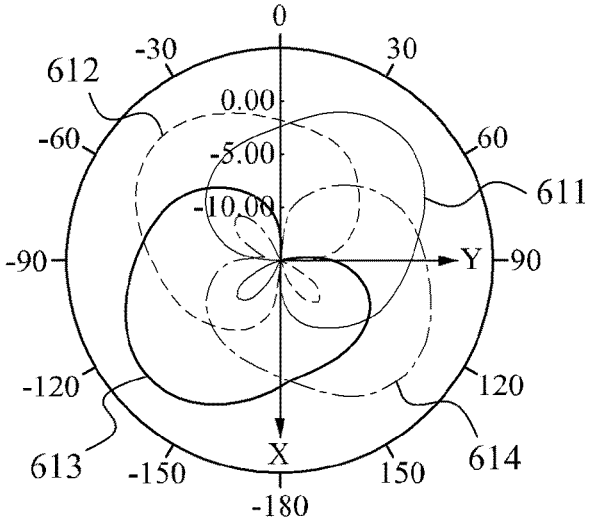
FIG. 6C shows a low-frequency radiation pattern diagram of the antenna device with a high-frequency radiation pattern shown in FIG. 6A according to some embodiments of the present disclosure.

Referring to FIG. 6A and FIG. 6C, FIG. 6A is a high-frequency radiation pattern diagram of the antenna device 100 in an operation mode according to the embodiments shown in FIG. 1 to FIG. 3B, and FIG. 6C is a low-frequency radiation pattern diagram of the antenna device 100 in the same operation mode as in FIG. 6A according to the embodiments shown in FIG. 1 to FIG. 3B. In some embodiments, the operation modes illustrated in FIG. 6A and FIG. 6C are the high-frequency directional mode on θ=90° plane (e.g., the phase-shifting switch diodes D51, D52, D61 and D62 are off). On this occasion, the high-frequency radiation pattern diagram of the antenna device 100 has the radiation pattern 610 (as shown in FIG. 6A), and the low-frequency radiation pattern diagram of the antenna device 100 has the radiation pattern 611-614 (as shown in FIG. 6C).

As shown in FIG. 6C, the low-frequency radiation pattern diagram of the antenna device 100 includes the radiation pattern 611 of the antenna device 100 when the phase-shifting switch diodes D31, D32, D41, D42, D51, D52, D61, and D62 are off, the radiation pattern 612 of the antenna device 100 when the phase-shifting switch diodes D21, D22, D31, D32, D51, D52, D61, and D62 are off, the radiation pattern 613 of the antenna device 100 when the phase-shifting switch diodes D11, D12, D21, D22, D51, D52, D61, and D62 are off, and the radiation pattern 614 of the antenna device 100 when the phase-shifting switch diodes D11, D12, D41, D42, D51, D52, D61, and D62 are off. Based on the above, it can be seen that even if the antenna device 100 operates in the high-frequency directional mode (e.g., the antenna units 230 and 240 are on), the operation of the low-frequency directional mode is not affected by the radiation pattern 610 in the high-frequency directional mode and still maintains good directivity.

Figure 6D:
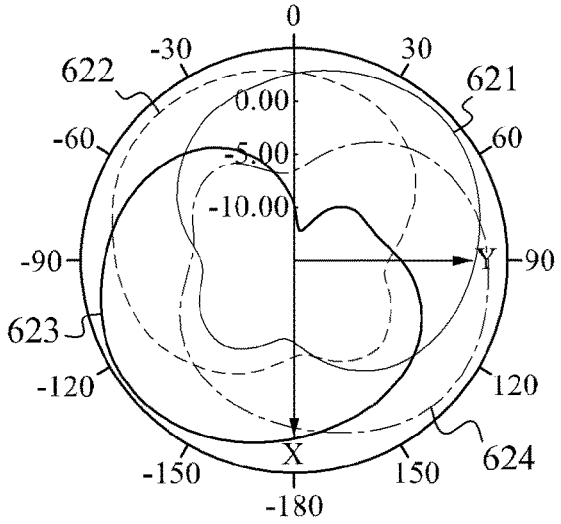
FIG. 6D shows a low-frequency radiation pattern diagram of the antenna device with a high-frequency radiation pattern shown in FIG. 6B according to some embodiments of the present disclosure.

Referring to FIG. 6B and FIG. 6D, FIG. 6B is a high-frequency radiation pattern diagram of the antenna device 100 in an operation mode according to the embodiments shown in FIG. 1 to FIG. 3B, and FIG. 6D is a low-frequency radiation pattern diagram of the antenna device 100 in the same operation mode as in FIG. 6B according to the embodiments shown in FIG. 1 to FIG. 3B. In some embodiments, the operation modes illustrated in FIG. 6B and FIG. 6D are the high-frequency directional mode on θ=60° plane (e.g., the phase-shifting switch diodes D51, D52, D61 and D62 are off). On this occasion, the high-frequency radiation pattern diagram of the antenna device 100 has the radiation pattern 620 (as shown in FIG. 6B), and the low-frequency radiation pattern diagram of the antenna device 100 has the radiation pattern 621-624 (as shown in FIG. 6D).

As shown in FIG. 6D, the low-frequency radiation pattern diagram of the antenna device 100 includes the radiation pattern 621 of the antenna device 100 when the phase-shifting switch diodes D31, D32, D41, D42, D51, D52, D61, and D62 are off, the radiation pattern 622 of the antenna device 100 when the phase-shifting switch diodes D21, D22, D31, D32, D51, D52, D61, and D62 are off, the radiation pattern 623 of the antenna device 100 when the phase-shifting switch diodes D11, D12, D21, D22, D51, D52, D61, and D62 are off, and the radiation pattern 624 of the antenna device 100 when the phase-shifting switch diodes D11, D12, D41, D42, D51, D52, D61, and D62 are off. Based on the above, it can be seen that when the antenna device 100 operates in the high-frequency directional mode (e.g., the antenna units 230 and 240 are on), the operation of the low-frequency directional mode is not affected by the radiation pattern 620 in the high-frequency directional mode and still maintains good directivity.

In summary, the present disclosure provides a plurality of phase-shifting switch diodes D11-D82 on the antenna units 210-280 in the antenna device 100 to achieve radiation patterns at the high and low frequencies by turning on and off the plurality of phase-shifting switch diodes D11-D82, and therefore the antenna device 100 can attain a better front-to-back ratio.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. An antenna device, comprising:

a plurality of first antenna units, generating radio frequency (RF) signals operating at a first frequency;

a plurality of second antenna units, each second antenna being coupled to a corresponding first antenna unit of the first antenna units, and generating RF signals operating at a second frequency, the first frequency being greater than the second frequency;

a plurality of first switching circuits, coupled to the plurality of first antenna units, and configured to selectively enable at least one of the plurality of first antenna units according to a plurality of control signals sent from a control circuit, wherein each of the plurality of first switching circuits comprises a first switching element and a second switching element, the first switching element is connected in parallel with an inductor, the second switching element is connected in parallel with another inductor; and a plurality of second switching circuits, coupled to the plurality of second antenna units, and configured to selectively enable at least one of the plurality of second antenna units according to the plurality of control signals, wherein each of the plurality of first switching circuits comprises:

a first inductor, a first terminal of the first inductor configured to receive a corresponding control signal of the control signals;

a second inductor, a first terminal of the second inductor coupled to a second terminal of the first inductor, and a first terminal of the first switching element coupled to a second terminal of the first inductor and a first terminal of the second inductor;

a first capacitor, a first terminal of the first capacitor coupled to a second terminal of the second inductor and a second terminal of the first switching element, and a second terminal of the first inductor configured to receive the RF signals from a signal feeding point;

a third inductor, a first terminal of the third inductor coupled to a second terminal of the second inductor, a second terminal of the first switching element and a first terminal of the first capacitor;

a fourth inductor, a first terminal of the fourth inductor coupled to a second terminal of the third inductor, and a first terminal of the second switching element coupled to a second terminal of the third inductor and a first terminal of the fourth inductor;

a second capacitor, a first terminal of the second capacitor coupled to a second terminal of the third inductor, a first terminal of the fourth inductor and a first terminal of the second switching element while a second terminal of the second capacitor coupled to an antenna ground terminal;

a fifth inductor, a first terminal of the fifth inductor coupled to a second terminal of the fourth inductor and a second terminal of the second switching element while a second terminal of the fifth inductor being grounded;

a third capacitor, a first terminal of the third capacitor coupled to a second terminal of the fifth inductor and grounded; and a sixth inductor, a first terminal of the sixth inductor coupled to the first terminal of the third capacitor and grounded while a second terminal of the sixth inductor coupled to a second terminal of the third capacitor.

2. The antenna device according to claim 1, wherein each of the plurality of first switching circuits further comprises:

a filter, coupled to the first switching element and configured to block and prevent the RF signals operating at the second frequency from affecting a radiation pattern generated by the first antenna unit.

3. The antenna device according to claim 1, wherein each of the plurality of first switching circuits further comprises:

a plurality of first impedance units, coupled to the plurality of first antenna units and connected in parallel or in series with the first switching element or the second switching element to block interference among the plurality of control signals and block interference among the RF signals operating at the first frequency, each of the plurality of second switching circuits further comprises:

a third switching element and a fourth switching element; and a plurality of second impedance units, coupled to the plurality of second antenna units, and connected in parallel or in series with the third switching element or the fourth switching element to block interference among the plurality of control signals and block interference among the RF signals operating at the second frequency.

4. The antenna device according to claim 3, wherein the plurality of first impedance units comprise a plurality of capacitors and a plurality of inductors, wherein the plurality of capacitors are configured to block interference among the plurality of control signals, and the inductors are configured to block interference among the RF signals.

5. The antenna device according to claim 1, wherein each of the plurality of second switching circuits comprises:

a first inductor, a first terminal of the first inductor configured to receive a corresponding control signal of the control signals;

a second inductor, a first terminal of the second inductor coupled to a second terminal of the first inductor;

a third inductor, a first terminal of the third inductor coupled to a second terminal of the second inductor;

a first capacitor, a first terminal of the first capacitor coupled to a second terminal of the second inductor and a first terminal of the third inductor while a second terminal of the first capacitor coupled to a second terminal of the third inductor;

a third switching element, a first terminal of the third switching element coupled to a second terminal of the third inductor and a second terminal of the first capacitor;

a fourth inductor, a first terminal of the fourth inductor coupled to a second terminal of the third switching element;

a second capacitor, a first terminal of the second capacitor coupled to a second terminal of the third switching element and the first terminal of the fourth inductor while a second terminal of the second capacitor coupled to a second terminal of the fourth inductor;

a third capacitor, a first terminal of the third capacitor coupled to a second terminal of the second capacitor and the second terminal of the fourth inductor;

a fifth inductor, a first terminal of the fifth inductor coupled to the second terminal of the second capacitor and the second terminal of the fourth inductor;

a fourth capacitor, a first terminal of the fourth capacitor coupled to the second terminal of the second capacitor and the second terminal of the fourth inductor;

a sixth inductor, a first terminal of the sixth inductor coupled to the second terminal of the fourth capacitor;

a fifth capacitor, a first terminal of the fifth capacitor coupled to the second terminal of the second capacitor and the second terminal of the fourth inductor while a second terminal of the fifth capacitor coupled to an antenna ground terminal;

a sixth capacitor, a first terminal of the sixth capacitor coupled to a second terminal of the third capacitor, a second terminal of the fifth inductor and a second terminal of the sixth inductor;

a seventh inductor, a first terminal of the seventh inductor coupled to a second terminal of the third capacitor, a second terminal of the fifth inductor, a second terminal of the sixth inductor and a first terminal of the sixth capacitor;

a seventh capacitor, a first terminal of the seventh capacitor coupled to a second terminal of the third capacitor, the second terminal of the fifth inductor, the second terminal of the sixth inductor, the first terminal of the sixth capacitor and the first terminal of the seventh inductor while a second terminal of the seventh capacitor configured to receive the RF signals from the antenna feeding point;

a fourth switching element, a first terminal of the fourth switching element coupled to the second terminal of the sixth capacitor and the second terminal of the seventh inductor;

an eighth inductor, a first terminal of the eighth inductor coupled to a second terminal of the fourth switching element;

an eighth capacitor, a first terminal of the eighth capacitor coupled to a first terminal of the eighth inductor, and a second terminal of the eighth capacitor coupled to a second terminal of the eighth inductor;

a ninth inductor, a first terminal of the ninth inductor coupled to the second terminal of the eighth inductor and the second terminal of the eighth capacitor; and a tenth inductor, a first terminal of the tenth inductor coupled to a second terminal of the ninth inductor while a second terminal of the tenth inductor being grounded.

6. The antenna device according to claim 1, wherein each of the plurality of first antenna units comprises:

a first radiator, disposed on a first surface of a substrate; and a second radiator, coupled to the first radiator, and disposed on a second surface of the substrate, wherein the first surface is opposite the second surface, wherein each of the plurality of second antenna units comprises:

a third radiator, disposed on the first surface of the substrate; and a fourth radiator, coupled to the third radiator, and disposed on the second surface of the substrate.

7. The antenna device according to claim 1, further comprising:

a plurality of reflecting units, coupled to a substrate, and the reflecting units disposed on two sides of each first antenna unit and on two sides of each second antenna unit, and configured to adjust radiation patterns generated by the plurality of first antenna units and the plurality of second antenna units.

8. The antenna device according to claim 1, further comprising:

a plurality of transmitting lines, each of the plurality of transmitting lines connected to a signal feeding point, a corresponding first antenna unit of the first antenna units and a corresponding second antenna unit of the second antenna units.

9. The antenna device according to claim 8, wherein the corresponding first antenna unit of the first antenna units, the corresponding second antenna unit of the second antenna units, and a corresponding transmission line of the transmitting lines are arranged in an F shape, and the signal feeding point is disposed at an intersection of the plurality of transmitting lines and coupled to the plurality of first antenna units and the plurality of second antenna units through the plurality of transmitting lines.

* * * * *